US011548668B2

(12) United States Patent
Chen et al.

(10) Patent No.: US 11,548,668 B2
(45) Date of Patent: Jan. 10, 2023

(54) SLEEVE WRAPPING DEVICE

(71) Applicant: TRIPLE WIN TECHNOLOGY(SHENZHEN) CO.LTD., Shenzhen (CN)

(72) Inventors: Zi-Ling Chen, Shenzhen (CN); Xiao-Bo Chen, Shenzhen (CN)

(73) Assignee: TRIPLE WIN TECHNOLOGY(SHENZHEN) CO.LTD., Shenzhen (CN)

( * ) Notice: Subject to any disclaimer, the term of this patent is extended or adjusted under 35 U.S.C. 154(b) by 121 days.

(21) Appl. No.: 17/167,880

(22) Filed: Feb. 4, 2021

(65) Prior Publication Data

US 2021/0331818 A1 Oct. 28, 2021

(30) Foreign Application Priority Data

Apr. 23, 2020 (CN) ..... 202020628000.7

(51) Int. Cl.

| | |
|---|---|
| ***B65B 41/16*** | (2006.01) |
| ***B65B 11/10*** | (2006.01) |
| ***B65B 11/48*** | (2006.01) |
| *A41B 7/12* | (2006.01) |
| *A41D 27/12* | (2006.01) |

(52) U.S. Cl.

CPC ..... *B65B 11/48* (2013.01); *B65B 11/10* (2013.01); *B65B 41/16* (2013.01); *A41B 7/12* (2013.01); *A41D 27/12* (2013.01)

(58) Field of Classification Search

CPC ..... B65B 11/10; B65B 11/48; B65B 41/16; A41B 7/12; A41D 27/12; B65C 3/00; B65C 3/02; B65C 5/00; B65C 5/02; B65C 9/18; B65C 9/1865; B65C 9/1869; B65C 9/262; B65C 9/30; B65C 9/32; Y10T 156/1707

USPC ... 53/135.1, 137.2, 203, 209, 220, 228, 229, 53/586, 592; 2/59; 156/DIG. 5, DIG. 6, (Continued)

(56) References Cited

U.S. PATENT DOCUMENTS 3,432,988 A * 3/1969 Minten ..... B65B 9/026 53/586
3,434,902 A * 3/1969 Bliss ..... B65C 9/36 156/542

(Continued)

FOREIGN PATENT DOCUMENTS

JP 64058607 A * 3/1989
JP 05032235 A * 2/1993

(Continued)

*Primary Examiner* — Stephen F. Gerrity
(74) *Attorney, Agent, or Firm* — ScienBiziP, P.C.

(57) ABSTRACT

A sleeve wrapping device includes a first fixing base, a second fixing base, a first supporting frame protruded from the first fixing base, a second supporting frame protruded from the second fixing base, a first roller mounted on the first supporting frame, a second roller mounted on the second supporting frame, and a sleeve wrapping film comprising a substrate and a plurality of adhesive layers. The first roller and the second roller move back and forth relative to the first supporting frame and the second supporting frame. The sleeve wrapping device is switched between a first state that the first roller and the second roller are in contact with each other and a second state that the first roller and the second roller are separated. The substrate winds the first roller and the second roller.

11 Claims, 7 Drawing Sheets

(58) Field of Classification Search
USPC .... 156/DIG. 19, DIG. 20, DIG. 33, DIG. 37, 156/DIG. 39, DIG. 40
See application file for complete search history.

(56) References Cited

U.S. PATENT DOCUMENTS

| | | | | | |
|---|---|---|---|---|---|
| 4,643,786 | A * | 2/1987 | Cecchi | B65C 9/34 | 156/DIG. 6 |
| 4,936,946 | A * | 6/1990 | Karlyn | B65C 3/10 | 156/540 |
| 4,944,829 | A * | 7/1990 | Tuttle et al. | B65C 3/02 | 156/DIG. 36 |
| 7,503,078 | B2 * | 3/2009 | Bernard et al. | A41D 27/12 | 2/400 |
| 2004/0226650 | A1 * | 11/2004 | Galles et al. | B65C 9/1869 | 156/247 |
| 2007/0294798 | A1 * | 12/2007 | York et al. | A47G 11/001 | 2/59 |
| 2013/0318914 | A1 * | 12/2013 | Takata | B65B 41/16 | 53/203 |

FOREIGN PATENT DOCUMENTS

| | | | | |
|---|---|---|---|---|
| WO | WO-03060843 | A1 * | 7/2003 | B65C 9/18 |
| WO | WO-2019164866 | A1 * | 8/2019 | B65C 3/02 |

* cited by examiner

SLEEVE WRAPPING DEVICE

FIELD

The subject matter herein generally relates to a sleeve wrapping device.

BACKGROUND

Before entering a dust-free workshop, sleeves of the personnel need to be sealed to decrease a risk of product contamination. However, it is inconvenient to wrap the sleeves manually.

Therefore, there is room for improvement within the art.

BRIEF DESCRIPTION OF THE DRAWINGS

Implementations of the present disclosure will now be described, by way of embodiments, with reference to the attached figures.

DETAILED DESCRIPTION

Figure 1:
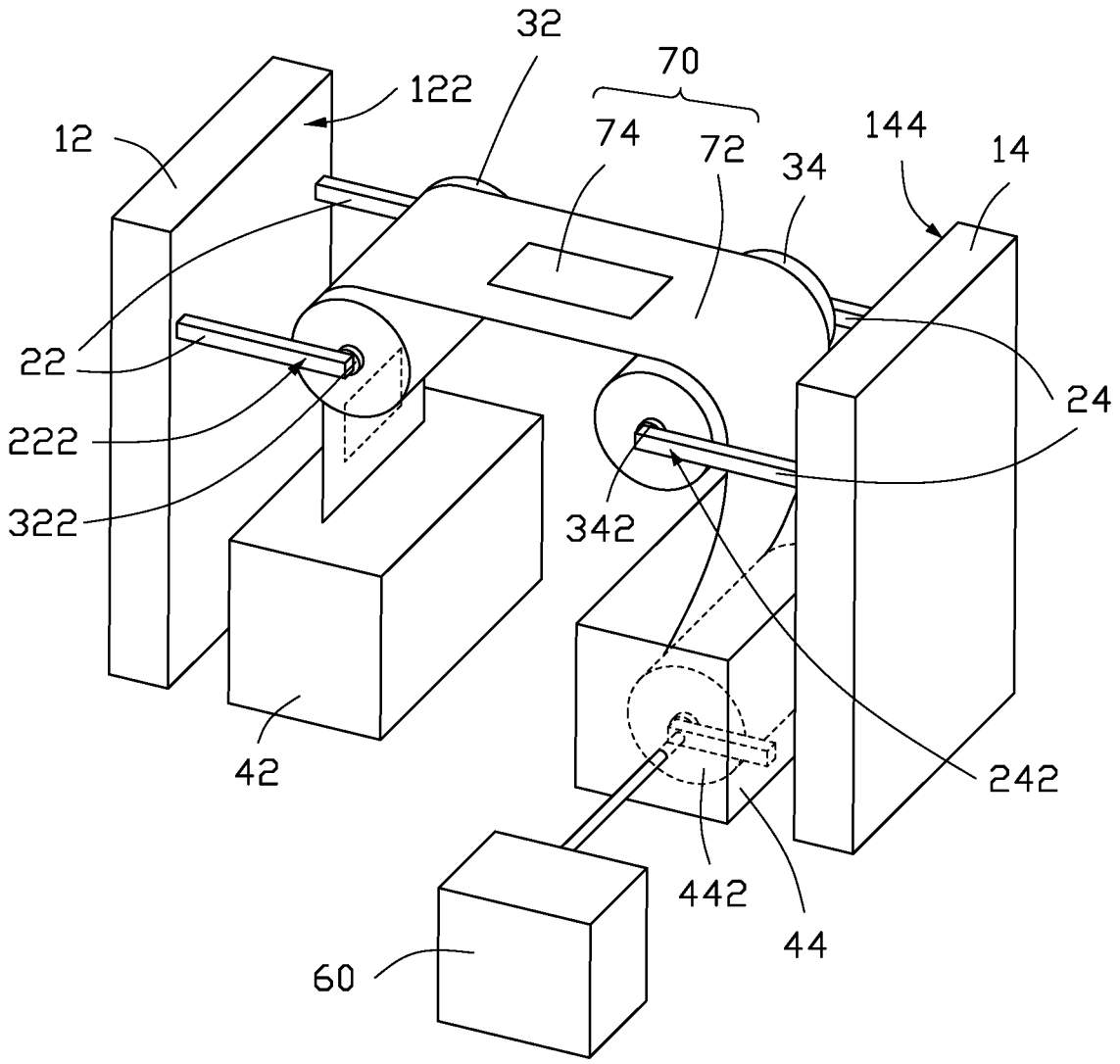
FIG. 1 is a diagram of an embodiment of a sleeve wrapping device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, group, series, and the like.

FIG. 1 illustrates an embodiment of a sleeve wrapping device 100. The sleeve wrapping device 100 includes a first fixing base 12, a second fixing base 14, a first supporting frame 22, a second supporting frame 24, a first roller 32, a second roller 34, a discharge box 42, a receiving box 44, and a sleeve wrapping film 70.

The first fixing base 12 is spaced from the second fixing base 14. The first supporting frame 22 is protruded from a side of the first fixing base 12 facing the second fixing base 14, and the second supporting frame 24 is protruded from a side of the second fixing base 14 facing the first fixing base 12. The first supporting frame 22 faces and is spaced from the second supporting frame 24. The first roller 32 is rotatably mounted on the first supporting frame 22, and the second roller 34 is rotatably mounted on the second supporting frame 24. The first roller 32 moves back and forth relative to the first supporting frame 22 and the second supporting frame 24. The second roller 34 moves back and forth relative to the first supporting frame 22 and the second supporting frame 24. That is, the first roller 32 moves back and forth between the first supporting frame 22 and the second supporting frame 24, and the second roller 34 moves back and forth between the first supporting frame 22 and the second supporting frame 24.

The discharge box 42 is used to contain a portion of the sleeve wrapping film 70 which is unused. The receiving box 44 is used to collect the sleeve wrapping film 70 which is used. In at least one embodiment, the discharge box 42 is located between the first fixing base 12 and the second fixing base 14. The receiving box 44 is located between the discharge box 42 and the second fixing base 14.

When the first roller 32 and the second roller 34 move, the sleeve wrapping device 100 is switched between a first state and a second state. The first state is that the first roller 32 and the second roller 34 are in contact with each other. The second state is that the first roller 32 and the second roller 34 are separated.

In at least one embodiment, the sleeve wrapping film 70 includes a substrate 72 and a plurality of adhesive layers 74 on a side of the substrate 72. The plurality of the adhesive layers 74 is spaced from each other and arranged along a length direction of the substrate 72. The substrate 72 includes a first end and a second end. The first end and the second end are located two opposite side of the substrate 72 along the length direction. The first end of the substrate 72 is received in the discharge box 42, the second end of the substrate 72 after sequentially winding the first roller 32 and the second roller 34 is received in the receiving box 44.

When the sleeve wrapping device 100 is switched from the second state to the first state, two end portions of one of the plurality of adhesive layers 74 along the length direction are connected to surround a target object 80 (for example, an arm). Thus, the sleeve wrapping device 100 may automatically complete a sleeve wrapping process by the adhesive layer 74.

In at least one embodiment, the first fixing base 12 and the second fixing base 14 may be rectangular parallelepipeds. The first fixing base 12 and the second fixing base 14 may be symmetrically arranged. In another embodiment, each of the first fixing base 12 and the second fixing base 14 may have any shape. The first fixing base 12 supports the first supporting frame 22, and the second fixing base 14 supports the second supporting frame 24.

In at least one embodiment, the first fixing base 12 includes a first surface 122. The second fixing base 14 includes a second surface 144. The second surface 144 faces the first surface 122. The first supporting frame 22 is protruded from the first surface 122. The second supporting frame 24 is protruded from the second surface 144.

In at least one embodiment, a first end portion 222 of the first supporting frame 22 away from the first fixing base 12 and a second end portion 242 of the second supporting frame 24 away from the second fixing base 14 are at the same height. In at least one embodiment, the first supporting frame 22 and the second supporting frame 24 are both horizontally arranged.

In at least one embodiment, the sleeve wrapping device 100 includes two first supporting frames 22 and two second supporting frames 24. Two first supporting frames 22 are mounted on the first fixing base 12 and spaced from each other. Two second supporting frames 24 are mounted on the second fixing base 14 and spaced from each other. A first connecting rod 322 connects the first ends 222 of the first supporting frames 22 and passes through the first roller 32. The first roller 32 rotates around the first connecting rod 322. A second connecting rod 342 connects the second ends 242 of the second supporting frames 24 and passes through the second roller 34. The second roller 34 rotates around the second connecting rod 342.

Figure 2:
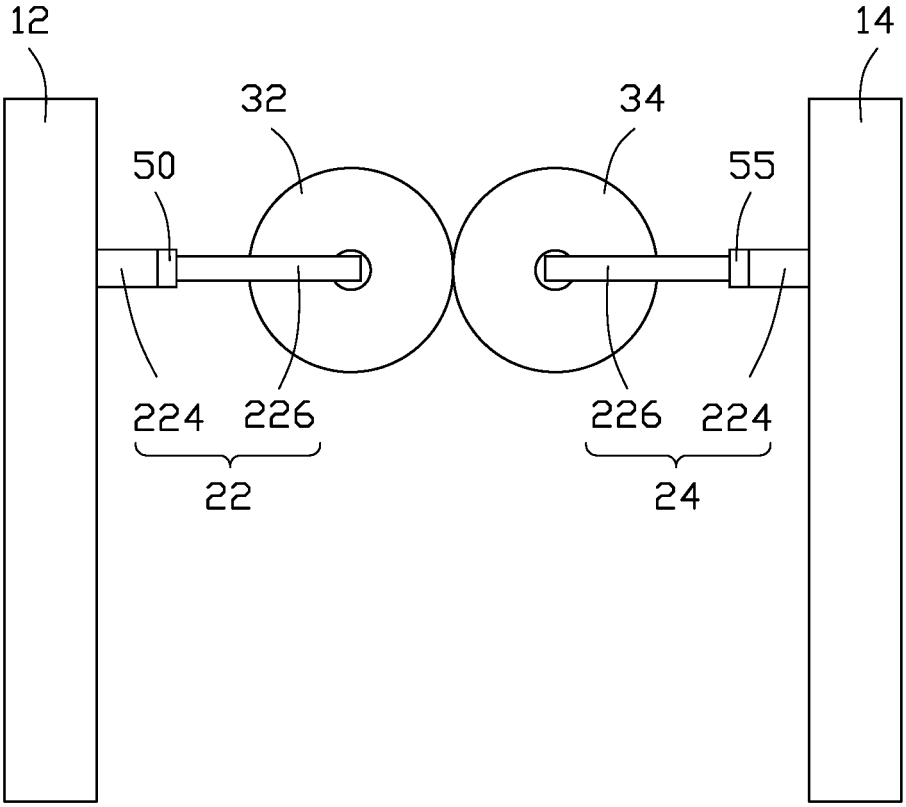
FIG. 2 is a front view of the sleeve wrapping device of FIG. 1.

In at least one embodiment, referring to FIG. 2, the first supporting frame 22 may be elastically connected to the first fixing base 12 via a first elastic component 50 (such as a spring), so that the first supporting frame 22 is telescopically mounted on the first fixing base 12. The first connecting rod 322 is fixedly connected the first supporting frame 22. Thus, the first roller 32 moves back and forth relative to the first fixing base 12. The second supporting frame 24 may be elastically connected to the second fixing base 14 via a second elastic component 55, so that the second supporting frame 24 is telescopically mounted on the second fixing base 14. The second connecting rod 342 is fixedly connected the second supporting frame 24. Thus, the second roller 34 moves back and forth relative to the second fixing base 14.

In at least one embodiment, referring to FIG. 2, the first supporting frame 22 may include a fixing rod 224 and a movable rod 226. The fixing rod 224 is fixed on the first fixing base 12. The movable rod 226 is connected to an end portion of the fixing rod 224 facing away from the first fixing base 12 via the first elastic component 50, so that the movable rod 226 moves back and forth relative to the first fixing base 12. The second supporting frame 24 may also include a fixing rod 224 and a movable rod 226. The movable rod 226 is connected to an end portion of the fixing rod 224 of the second supporting frame 24 facing away from the second fixing base 14 via the second elastic component 55, so that the movable rod 226 of the second supporting frame 24 moves back and forth relative to the second fixing base 14.

In another embodiment, the first supporting frame 22 may be fixedly connected to the first fixing base 12, and the first connecting rod 322 may be connected to the first supporting frame 22 via a first elastic component 50. So that the first connecting rod 322 is telescopically mounted on the first supporting frame 22, and the first roller 32 moves back and forth relative to the first fixing base 12. The second supporting frame 24 may be fixedly connected to the second fixing base 14, and the second connecting rod 342 may be connected to the second supporting frame 24 via a second elastic component 55. So that the second connecting rod 342 is telescopically mounted on the second supporting frame 24, and the second roller 34 moves back and forth relative to the second fixing base 14.

The plurality of adhesive layers 74 is disposed on a surface of the substrate 72. The substrate 72 is non-sticky, and each adhesive layer 74 is sticky. A part of the sleeve wrapping film 70 received in the discharge box 42 is wound. A third roller 442 is received in the receiving box 44 and is connected to a driving device 60 (such as a motor). The second end of the substrate 72 is connected to the third roller 442. When the driving device 60 drives the third roller 442 to rotate, the sleeve wrapping film 70 is pulled out of the discharge box 42 and is wound on the third roller 442 after winding around the first roller 32 and the second roller 34.

Figure 3:
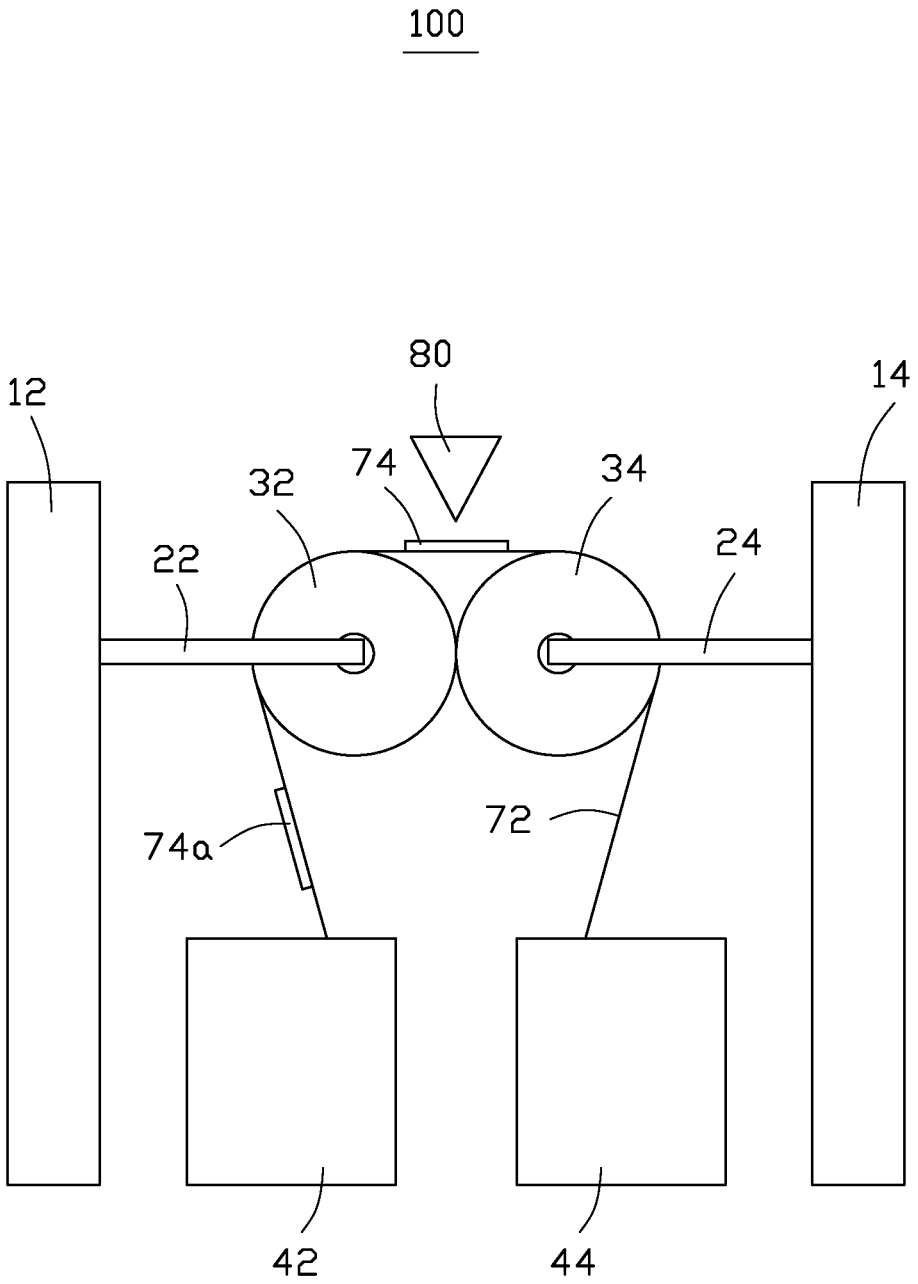
FIG. 3 is a schematically diagram of the sleeve wrapping device of FIG. 1 in a first state.

Referring to FIG. 3, when in the first state, the first roller 32 is in contact with the second roller 34, one of the plurality of adhesive layers 74 is located at a first side of the first roller 32 and the second roller 34 facing away from the discharge box 42 and the receiving box 44. At this time, a target object 80 is located at a side of the adhesive layer 74 facing away from the first roller 32 and the second roller 34.

Figure 4:
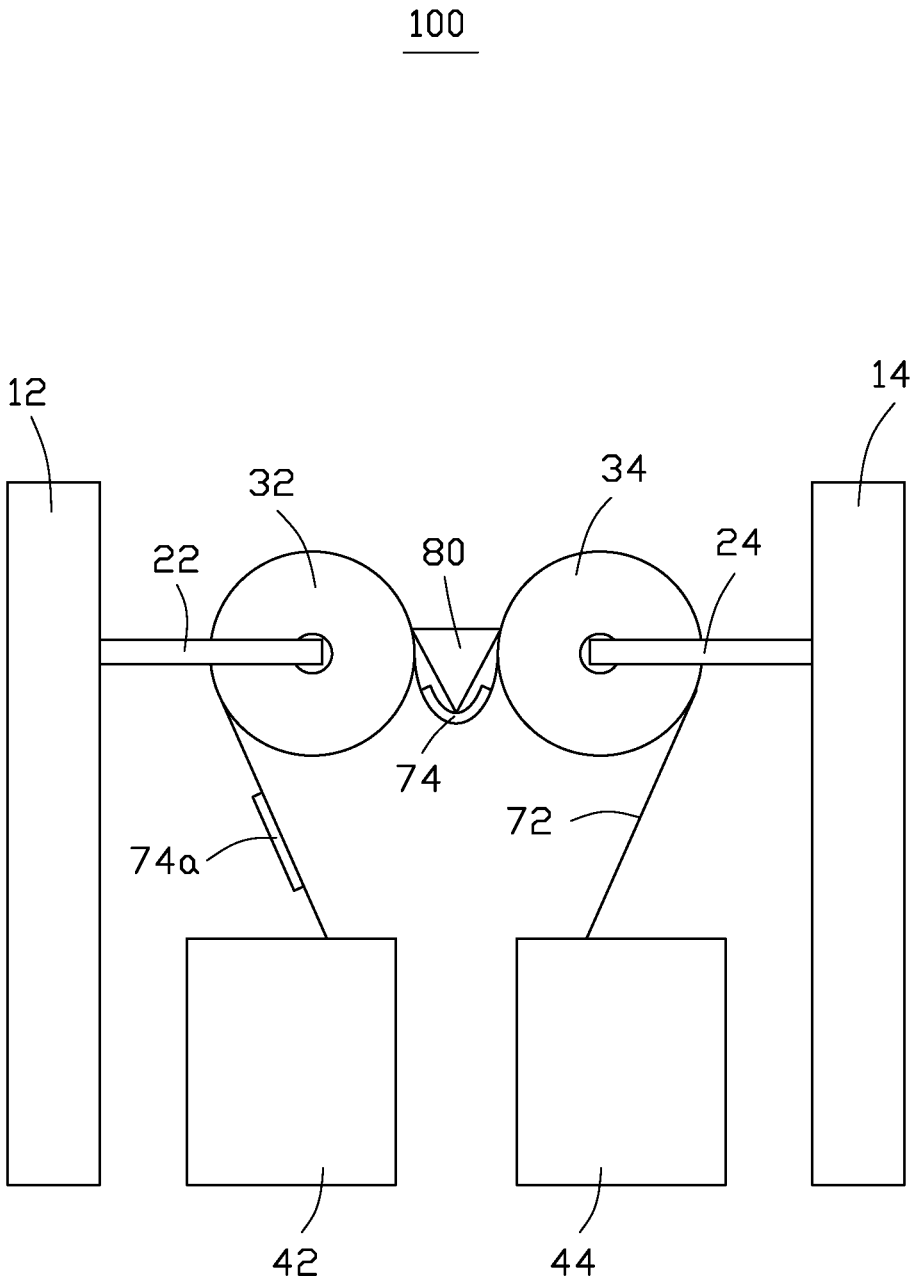
FIG. 4 is a schematically diagram of the sleeve wrapping device of FIG. 1 in another state.

Referring to FIG. 4, the target object 80 contacts the adhesive layer 74 and moves downward in the vertical direction, thereby separating the first roller 32 and the second roller 34 and converting into the second state. The first roller 32 moves toward the first fixing base 12 and the second roller 34 moves toward the second fixing base 14 until the target object 80 moves from the first side of the first roller 32 and the second roller 34 to a second side of the first roller 32 and the second roller 34 opposite to the first side.

Figure 5:
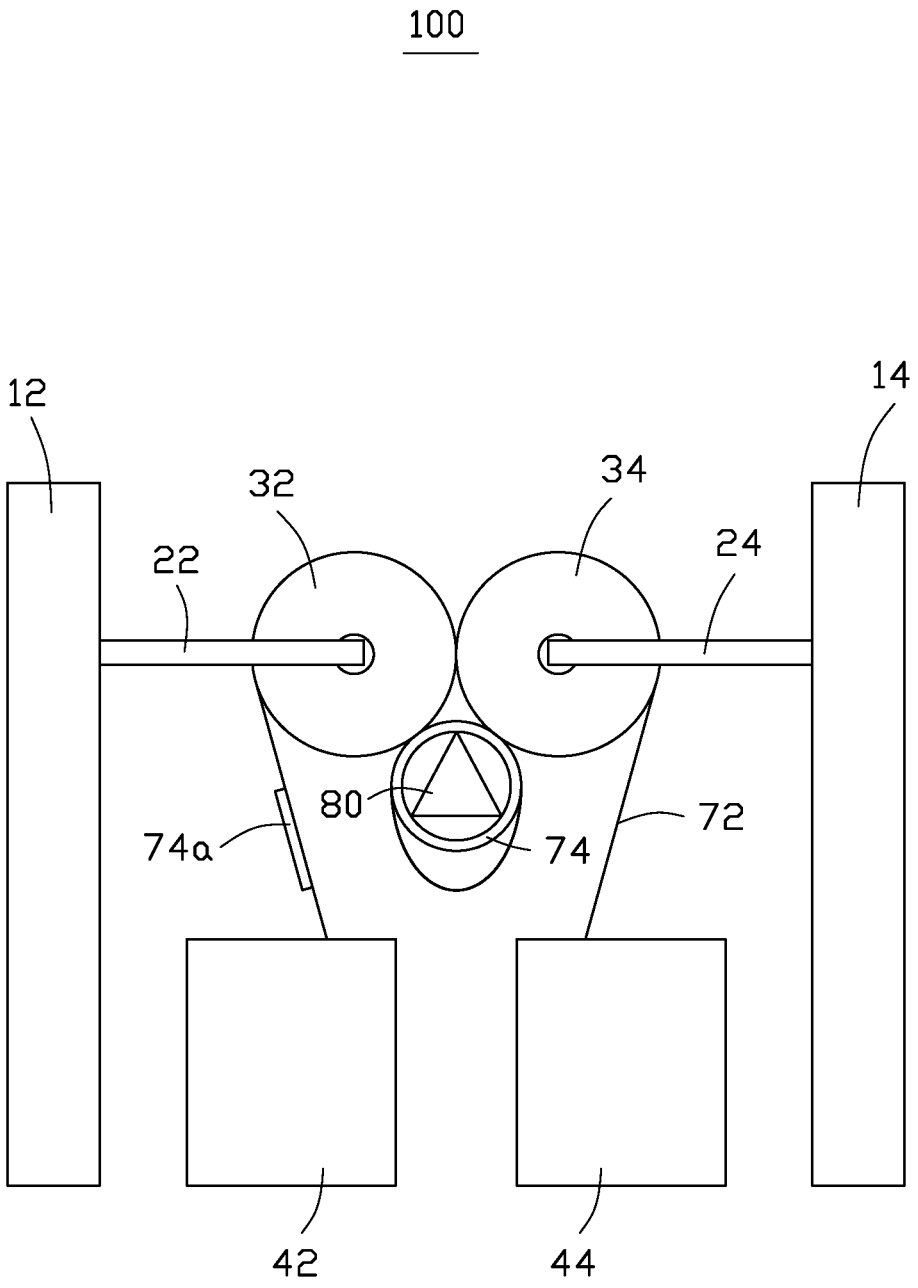
FIG. 5 is a schematically diagram of the sleeve wrapping device of FIG. 1 in a next state.

Referring to FIG. 5, when the target object 80 is located at the second of the first roller 32 and the second roller 34, the first roller 32 and the second roller 34 move toward to each other, thereby converting into the first state. At this time, the first roller 32 and the second roller 34 are in contact with each other, so that the two end portions of the adhesive layer 74 are attached to each other and surround the target object 80 under the cooperation of the first roller 32 and the second roller 34.

Figure 6:
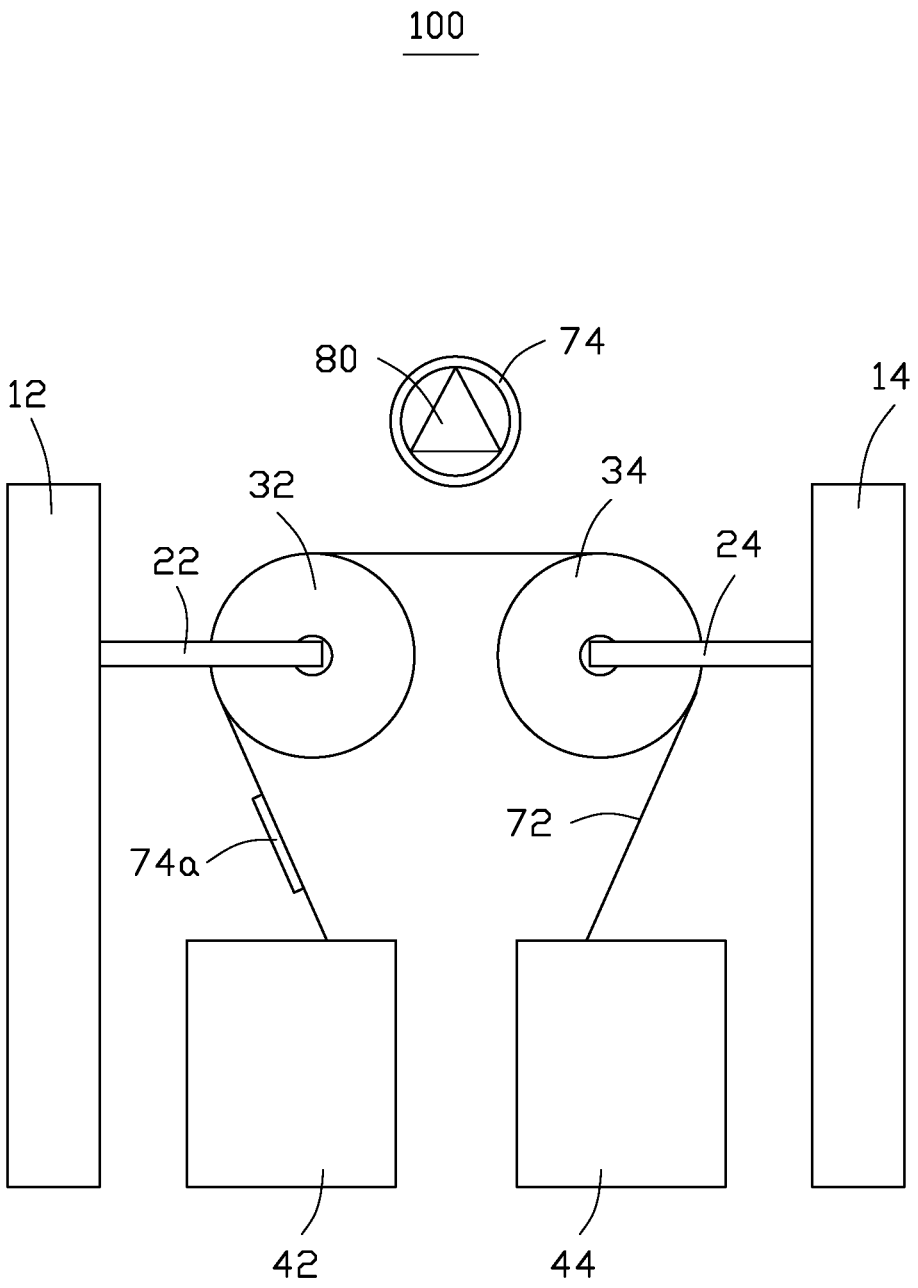
FIG. 6 is a schematically diagram of the sleeve wrapping device of FIG. 1 in a second state.

Referring to FIG. 6, after the two end portions of the adhesive layer 74 are attached, the target object 80 surrounded by the adhesive layer 74 moves upward in the vertical direction, thereby separating the first roller 32 and the second roller 34 and converting into the second state. The target object 80 surrounded by the adhesive layer 74 moves from the second side of the first roller 32 and the second roller 34 to the first side of the first roller 32 and the second roller 34.

Figure 7:
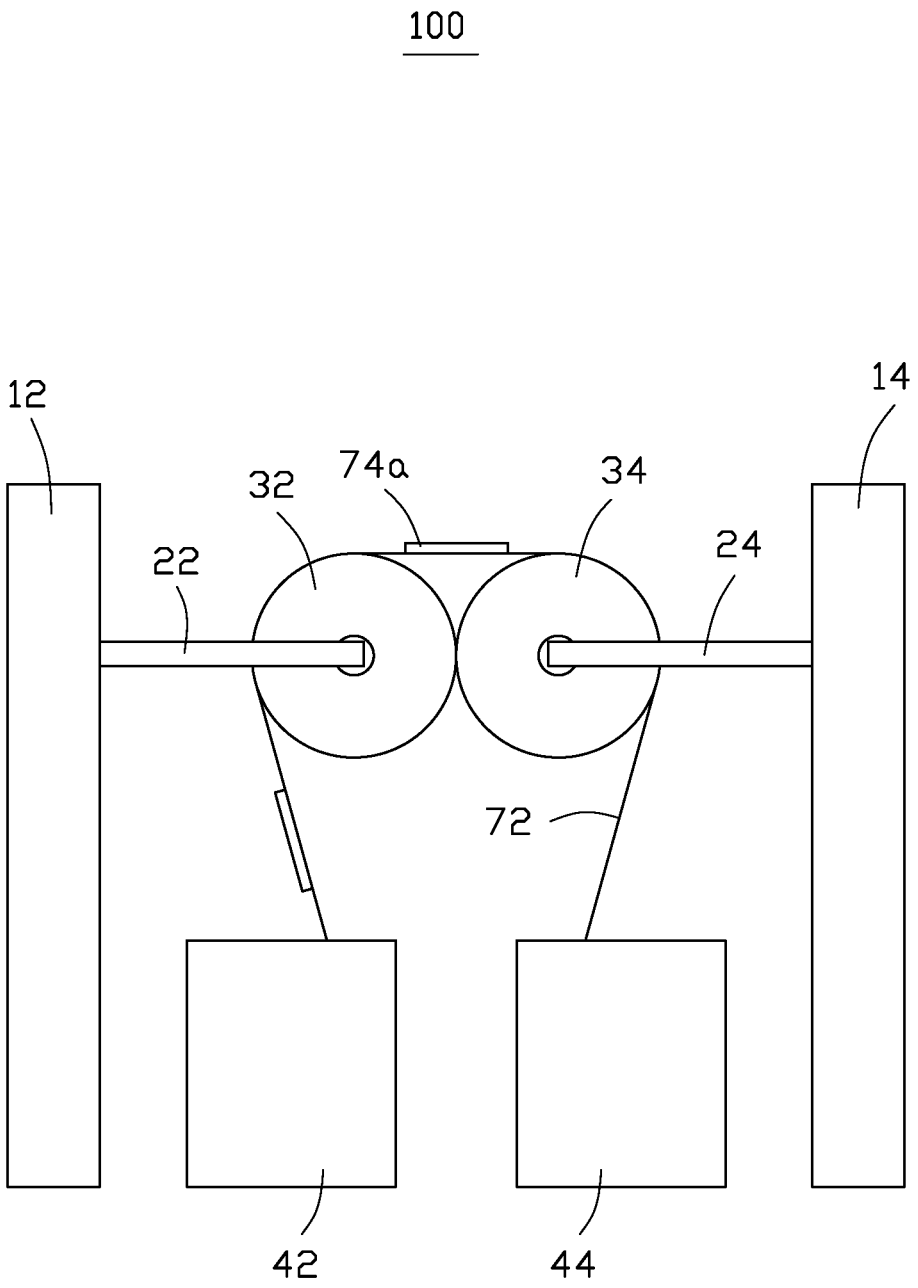
FIG. 7 is a schematically diagram of the sleeve wrapping device of FIG. 1 switched from the second state to the first state.

Referring to FIG. 7, after the target object 80 surrounded by the adhesive layer 74 is located at the first side of the first roller 32 and the second roller 34 again, the sleeve wrapping device 100 returns to the first state. A used part of the sleeve wrapping film 70 (i.e. the substrate without the adhesive layer 74) is transferred into the receiving box 44 under a pulling of the third roller 442 driven by the driving device 60, and another adhesive layer 74 is located at the first side of the first roller 32 and the second roller 34 facing away from the discharge box 42 and the receiving box 44 for wrapping around a next target object.

The first roller 32 and the second roller 34 of the sleeve wrapping device 100 provided in the present disclose moves back and forth relative to the first fixing base 12 and the second fixing base 14, thereby contacting and separating under an action of the target object 80. So that the sleeve wrapping device 100 is switched between the second state and the first state to complete the sleeve wrapping process.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A sleeve wrapping device comprising:

a first fixing base;

a second fixing base;

a first supporting frame protruded from a side of the first fixing base;

a second supporting frame protruded from a side of the second fixing base facing the first supporting frame;

a first roller rotatably mounted on the first supporting frame;

a second roller rotatably mounted on the second supporting frame; and a sleeve wrapping film comprising a substrate and a plurality of adhesive layers on a side of the substrate;

wherein the first roller moves back and forth relative to the first supporting frame and the second supporting frame, the second roller moves back and forth relative to the first supporting frame and the second supporting frame, thereby causing the first roller and second roller to become closer or further away from each other; the sleeve wrapping device is switchable between a first state and a second state, wherein in the first state, the first roller and the second roller are in contact with each other, and in the second state, the first roller and the second roller are separated; the plurality of the adhesive layers are spaced from each other; the substrate sequentially winds around the first roller and the second roller, when the sleeve wrapping device is switched from the second state to the first state, two end portions of one of the plurality of the adhesive layers are connected to surround a target object.

2. The sleeve wrapping device of claim 1, wherein the first supporting frame is elastically connected to the first fixing base via a first elastic component, the second supporting frame is elastically connected to the second fixing base via a second elastic component.

3. The sleeve wrapping device of claim 2, wherein the sleeve wrapping device further comprises a first connecting rod and a second connecting rod; the first connecting rod is connected to the first supporting frame, and the first roller is rotatably sleeved on the first connecting rod; the second connecting rod is connected to the second supporting frame, and the second roller is rotatably sleeved on the second connecting rod.

4. The sleeve wrapping device of claim 1, wherein the sleeve wrapping device further comprises a first connecting rod and a second connecting rod; the first connecting rod is elastically connected to the first supporting frame via a first elastic component, and the first roller is rotatably sleeved on the first connecting rod; the second connecting rod is elastically connected to the second supporting frame via a second elastic component, and the second roller is rotatably sleeved on the second connecting rod.

5. The sleeve wrapping device of claim 4, wherein the first supporting frame is elastically connected to the first fixing base via a third elastic component, the second supporting frame is elastically connected to the second fixing base via a fourth elastic component.

6. The sleeve wrapping device of claim 1, wherein the sleeve wrapping device further comprises a discharge box and a receiving box, the discharge box receives a first end portion of the sleeve wrapping film, the receiving box receives a second portion of the sleeve wrapping film.

7. The sleeve wrapping device of claim 6, wherein the sleeve wrapping device further comprises a third roller received in the receiving box for winding the second portion of the sleeve wrapping film.

8. The sleeve wrapping device of claim 7, wherein the sleeve wrapping device further comprises a driving device connected to the third roller for driving the third roller to rotate.

9. The sleeve wrapping device of claim 1, wherein the sleeve wrapping device comprises two first supporting frames and two second supporting frames, the first supporting frames are mounted on the first fixing base and spaced from each other, a first connecting rod connects the first supporting frames, and the first roller is rotatably sleeved on the first connecting rod; two second supporting frames are mounted on the second fixing base and spaced from each other, a second connecting rod connects the second supporting frames, and the second roller is rotatably sleeved on the second connecting rod.

10. The sleeve wrapping device of claim 1, wherein the first roller and the second roller are at a same height.

11. The sleeve wrapping device of claim 1, wherein the first supporting frame and the second supporting frame are parallel to each other.

* * * * *